US005572111A

United States Patent [19]

Dressler et al.

[11] Patent Number: 5,572,111

[45] Date of Patent: Nov. 5, 1996

[54] DEVICE FOR REGULATING A VOLTAGE DROP ACROSS A LOAD

[75] Inventors: Klaus Dressler, Löchgau; Andreas Koch, Bietigheim-Bissingen, both of Germany

[73] Assignee: Robert Bosch GmbH, Stuttgart, Germany

[21] Appl. No.: 311,801

[22] Filed: Sep. 26, 1994

[30] Foreign Application Priority Data

Oct. 20, 1993 [DE] Germany ..... 43 35 687.7

[51] Int. Cl.[6] ..... G05F 1/40

[52] U.S. Cl. ..... 323/273

[58] Field of Search ..... 323/273

[56] References Cited

U.S. PATENT DOCUMENTS

| | | | |
|---|---|---|---|
| 2,888,632 | 5/1959 | Livezey | 323/273 |
| 2,991,407 | 7/1961 | Murphy | 323/273 |
| 3,549,983 | 12/1970 | Sprogis | 323/273 |
| 5,175,489 | 12/1992 | Yasuo . | |
| 5,237,262 | 8/1993 | Ashley et al. | 323/284 |
| 5,491,401 | 2/1996 | Inoue et al. | 323/273 |

FOREIGN PATENT DOCUMENTS 3405599 8/1985 Germany .

*Primary Examiner*—Stuart N. Hecker
*Attorney, Agent, or Firm*—Kenyon & Kenyon

[57] ABSTRACT

A device for regulating a voltage drop across a load, particularly an electromagnetic load, includes an actuator connected in series with the load, a ground and a supply voltage. A first current balancing circuit provides an actual current which corresponds to the voltage across the load. A current source establishes a desired current. A second current balancing circuit provides a signal for actuation of the actuator as a function of a comparison of the actual current with the desired current, the actuator thereby regulating the voltage across the load.

9 Claims, 2 Drawing Sheets

DEVICE FOR REGULATING A VOLTAGE DROP ACROSS A LOAD

FIELD OF THE INVENTION

The present invention relates to a device for regulating the voltage drop across a load, and in particular across an electromagnetic load.

BACKGROUND OF THE INVENTION

Devices for regulating voltage are known in which the difference between a desired voltage and the measured voltage is fed to a regulator. This regulator forms a manipulated variable for the actuating of an actuator.

Ordinarily, the regulators include operational amplifiers and capacitors. Operational amplifiers, however, involve very high expense for parts and application. In particular, traditional regulators must be adjusted so that they provide stable operation.

The object of the present invention is to provide a voltage regulator device having a simple construction.

SUMMARY OF THE INVENTION

The voltage regulator device according to the present invention provides for regulating a voltage drop across a load, particularly an electromagnetic load. The load and an actuator are connected in series between a ground and a supply voltage. A first current balancing circuit is coupled to the load and provides an actual current which corresponds to the voltage across the load. A current source establishes a desired current. A second current balancing circuit is coupled to the first current balancing circuit and to the current source and provides for actuation of the actuator as a function of a comparison of the actual current with the desired current.

The present invention has the advantage that the voltage regulator has very few components and the components are easy to integrate. Furthermore, the voltage regulator according to the present invention provides stable operation and does not tend to oscillate. In particular, the regulator of the present invention need not be specially designed. The dynamic response of the regulator is determined by only a few components and can thus be easily controlled.

It is particularly advantageous to use the device of the present invention in combination with internal combustion engines, especially for the metering of fuel into the combustion chamber of the internal combustion engine. For this purpose, a solenoid valve can be used with particular advantage for regulating the metering of fuel into the internal combustion engine.

In this connection, it is necessary, particularly in the case of small loads, that very small amounts of injection be metered as precisely as possible. For this purpose, it is necessary to know the time when the armature of the solenoid valve, through which current is flowing, reaches an end position. This time is customarily referred to as the "begin of injection period" (BIP). This time is obtained by evaluating the variation of the current of the solenoid valve with respect to time. The temporal characteristic of the current is evaluated at a constant voltage to determine whether this characteristic exhibits a bend, or rather a substantial change in the differential coefficient of the current.

It is ordinarily provided that the voltage present on the solenoid valve is set to a constant value by means of a voltage regulator. It is particularly advantageous if the voltage regulator device according to the present invention is used for determining a value which represents the beginning of injection time or the end of injection time. In this case, the load is a solenoid valve for determining the amount of fuel injected into an internal combustion engine. The device according to the present invention is used to regulate the voltage on the solenoid valve to enable determination of the time when the armature of the solenoid valve reaches its end position.

DETAILED DESCRIPTION OF THE INVENTION

Figure 1:
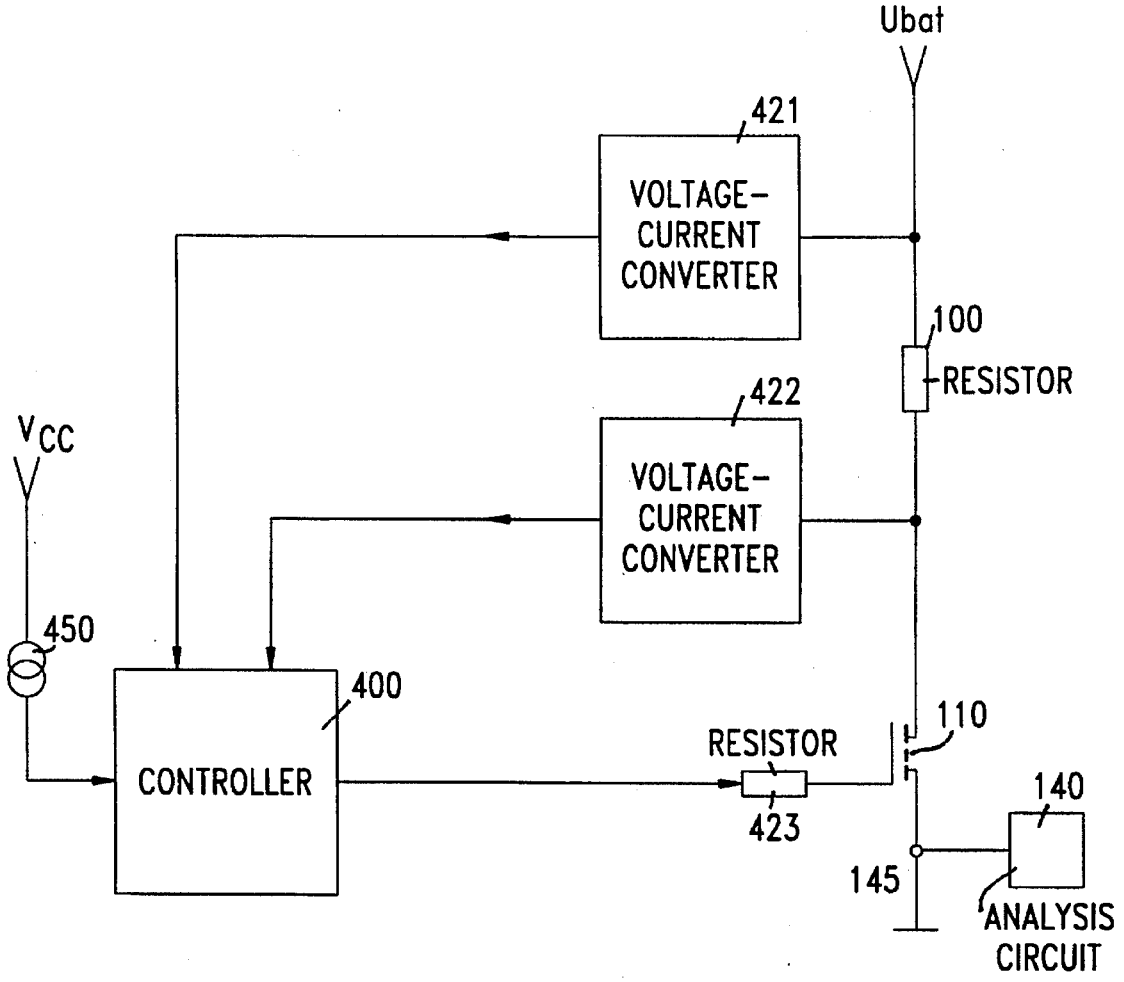
FIG. 1 illustrates a circuit for a voltage regulating device according to a preferred embodiment of the present invention.

FIG. 1 shows a preferred embodiment of a device according to the present invention for controlling a fuel-metering device controlled by a solenoid valve. One end of a load 100, for example an electromagnetic load, is connected to a voltage supply device (Ubat). The second end of the load 100 is connected to ground via a switch 110 and a sensor 145. The sensor 145 is connected to an analysis circuit 140. The switch 110 is preferably implemented with a field-effect transistor.

Voltage-current converters 421 and 422 tap off the voltage values present at the ends of the load 100. The voltage-current converters 421 and 422 provide currents $I_H$ and $I_L$, respectively, to a block 400. The block 400 is connected to a source of current 450 with a reference voltage $V_{CC}$. An output of the block 400 is connected via a gate resistor 423 to the gate of the field-effect transistor 110. The block 400 compares the currents $I_H$ and $I_L$ with the desired current $I_{set}$ and provides a control current $I_G$ for action on the switch 110, preferably in accordance with the following formula:

$$I_G=K\times(I_{set}+I_L-I_H)$$

in which K is an amplification factor.

Figure 2:
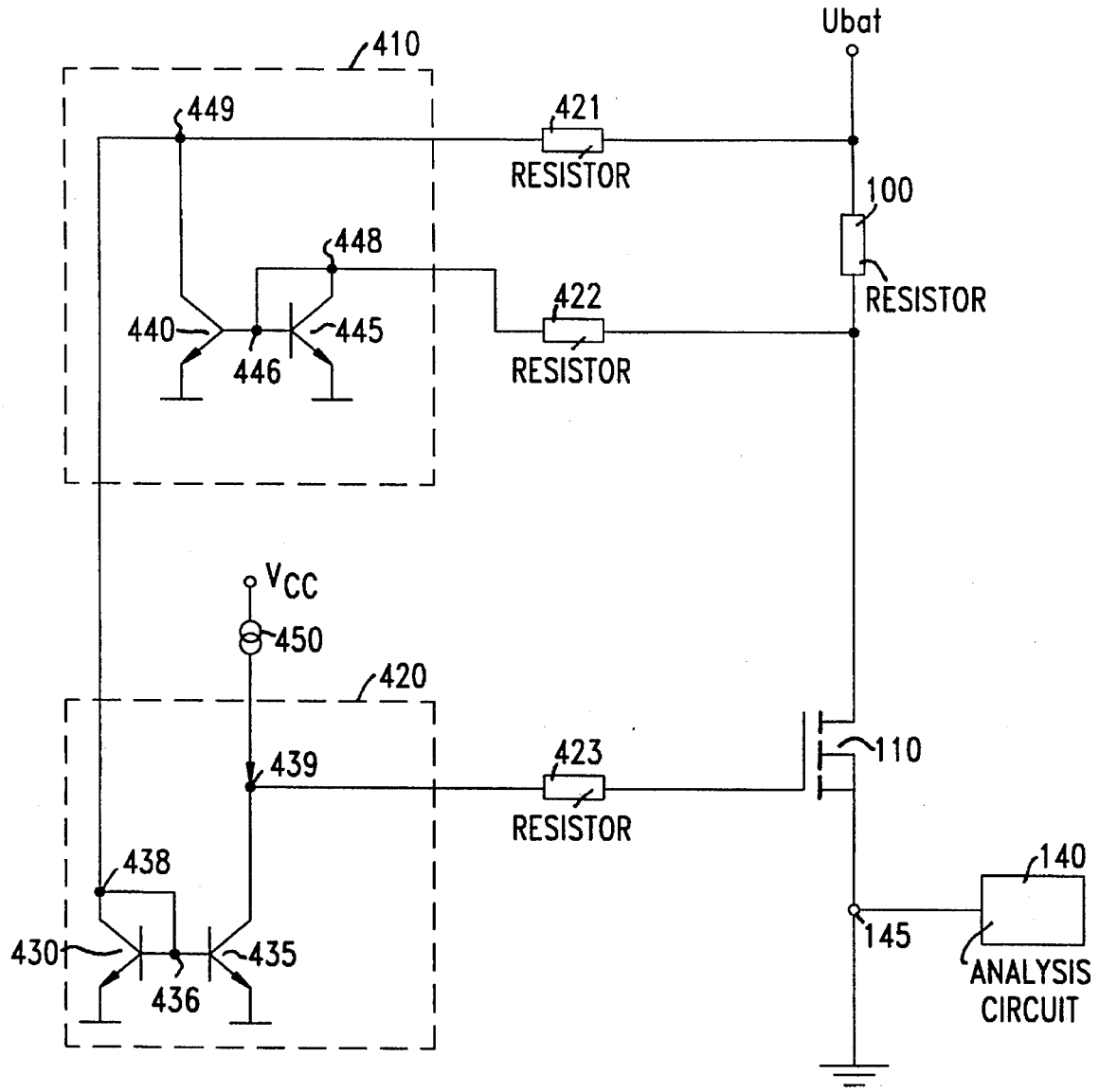
FIG. 2 shows a circuit for providing a control current according to a preferred embodiment of the present invention.

FIG. 2 shows the circuit for block 400 in detail. Parts which have already been described in FIG. 1 are provided with corresponding reference numerals in FIG. 2.

Ohmic resistors 421 and 422 are used as voltage-current converters in the preferred embodiment shown in FIG. 2. The voltage-current converters 421 and 422 act on the block 400, which includes a first current balancing circuit 410 and a second current balancing circuit 420. The voltage-current converters 421 and 422 feed currents to the first current balancing circuit 410. The first current balancing circuit 410 is, in turn, connected to the second current balancing circuit 420. The second current balancing circuit 420 is connected via a gate resistor 423 to the gate of the field-effect transistor 110.

By a current balancing circuit there is ordinarily understood the connecting together of two semiconductor elements in such a manner that a current through the one semiconductor element results in a corresponding or proportional current through the other semiconductor element.

If two transistors are used for a current balancing circuit, the two contact gaps of the transistor form two current paths.

In the case of the first current balancing circuit 410, a transistor 440 serves as a second current path and a transistor 445 serves as a first current path. The potentials at the two ends of the load 100 are tapped off via the two resistors 421 and 422. The first resistor 421 is connected via a junction point 449 with the collector of the transistor 440 of the second current path of the first current balancing circuit 410. The second resistor 422 is connected via a junction point 448 with the collector of the transistor 445 of the first current path of the first current balancing circuit 410. The base of the transistor 440 and the base of the transistor 445 are connected via the junction point 446. The point 446 is also connected to the junction point 448.

In the case of the second current balancing circuit 420, a transistor 430 forms the first current path. The collector of the transistor 430 is connected to the junction point 449 via the junction point 438. A transistor 435 forms the second current path. The base of the transistor 430 is connected to the base of the transistor 435 and to the junction point 436. This junction point 436 is also connected to the junction point 438. The collector-emitter current of the transistor 430 is impressed upon the transistor 435.

The second current path of the second current balancing circuit 420 is connected via a source of current 450 to a reference voltage $V_{CC}$. The collector of the transistor 435 is connected, via the junction point 439, to the source of current 450, to the gate resistor 423 and thus to the gate of the field-effect transistor 110.

The device according to the present invention operates as a voltage regulator in the following manner. The voltage values at the load 100 are transformed into currents by the resistors 421 and 422. The first current balancing circuit 410 forms the difference between the two currents. This actual current represents a measure of the voltage drop across the load.

This actual current acts on the first current path of the second current balancing circuit 420. The actual current is balanced and compared with the desired current which is supplied by the source of current 450. The desired current, supplied by the source of current 450, serves as a setpoint. The difference current between the desired current and the actual current acts on the gate of the field-effect transistor.

The desired current is selected so that a current which corresponds to the desired value supplied by the source of current 450 flows through the second path of the current balancing circuit 420 in steady state. If these two currents are equal, i.e. if the voltage drop across the load 100 corresponds to the desired voltage, then no gate current flows and the switch remains in its position.

If the voltage drop across the load 100 is too high, then a correspondingly higher current flows through the current balancing circuit, which, in its turn, causes the gate to be unloaded and the switch blocked. This causes the voltage over the load 100 to drop. The same is true if the voltage at the load assumes too small a value. In such case, too small a current flows through the current balancing circuit and the gate is loaded via the gate current. In corresponding fashion, the field-effect transistor becomes conductive and permits a stronger flow of current through the load.

The following procedure according to the present invention is employed. The voltage which is to be regulated at the load 100 is converted into a current by the voltage-current converters 421 and 422 and the current balancing circuit 410. The current balancing circuit 420 adjusts the voltage drop across the load to the desired current. This takes place in the manner that the current supplied by the first current balancing circuit 410 is balanced and subtracted at the junction point 439 from the desired current. This difference current is used to control the field-effect transistor. In other words, the current changes the gate loading and thus the condition of the field-effect transistor. The voltage regulation is in steady state when the current established in the second current path is equal to the current supplied by the source of current 450.

In order to influence the condition of the gate loading and thus the condition of the field-effect transistor, only very small currents are required. The second current balancing circuit serves to adapt the actual current to this current level.

As an alternative, it is possible to compare the actual current directly with the desired current. In such case, the difference current would be fed as input variable to the second current balancing circuit.

The current provided by the source of current 450 corresponds to the voltage dropping off across the load. By changing the value of the current, the voltage on the load can be directly controlled. There is a fixed, preferably proportional relationship between the current supplied by the source of current 450 and the voltage drop across the load. Therefore, a variable preset setpoint is possible for the voltage drop across the load.

The second current balancing circuit 420 operates substantially as a controller with proportional behavior. Due to the capacitances between gate and source and/or between gate and drain of the field-effect transistor 110, there is furthermore obtained an integral behavior of the current control.

The dynamic response of the controller is determined essentially by the source of current 450 and the capacitances of the field-effect transistor 110. The dynamic response can therefore be controlled very easily. Since no operational amplifier is used, there are no problems as to stability, i.e. the regulator does not tend to oscillate.

By the use of the current balancing circuits 410 and 420, the expense for parts is considerably reduced as compared with an embodiment employing operational amplifiers. Furthermore, the expense for the application of the regulator is reduced, since the control parameters need not be set.

The circuit shown in FIGS. 1 and 2, and particularly the current balancing circuits 410 and 420, can be easily integrated. All measurement values are converted directly into currents. This affords the advantage that there are no high voltages at the input of the integrated circuit. A high common-mode rejection is made possible by the voltage-current converter.

Based on the current flowing through the solenoid valve 100, the analysis circuit 140 determines the time when the armature of the solenoid valve through which current is flowing has reached its end position. The temporal characteristic of the current is evaluated at a constant voltage as to whether this temporal characteristic has a bend or a substantial change in the differential coefficient of the current. During the evaluation of the current and/or during the determination of the switching instant, the voltage on the solenoid valve can be regulated to a constant value by means of the device according to the present invention.

What is claimed is:

1. A device for regulating a voltage across a load, comprising:

an actuator coupled in series with the load, a voltage supply and a ground;

first means coupled to the load for providing an actual current indicative of the voltage across the load;

second means for establishing a desired current;

control means coupled to the first means and to the second means for providing a signal to the actuator as a function of a comparison between the actual current and the desired current, the actuator being responsive to the signal and thereby regulating the voltage across the load.

2. The device according to claim 1, wherein the first means includes at least one current balancing circuit.

3. The device according to claim 1, wherein the control means includes at least one current balancing circuit.

4. The device according to claim 1, wherein the signal provided by the control means is determined by a difference between the actual current and the desired current.

5. The device according to claim 1, wherein the actuator includes a field-effect transistor.

6. The device according to claim 1, wherein the load includes a solenoid valve for determining an amount of fuel injected into an internal combustion engine.

7. The device according to claim 6, wherein the device is for determining one of a beginning of injection value and an end of injection value.

8. A device for regulating a voltage drop across a load, comprising:

an actuator coupled in series to the load, a voltage supply and a ground;

a first current balancing circuit coupled to the load for providing an actual current representative of the voltage drop across the load;

a current source for providing a desired current;

a second current balancing circuit coupled to the first current balancing circuit and to the current source for providing a signal to the actuator, the signal being determined by a first difference between the actual current and the desired current, the actuator being responsive to the signal for regulating the voltage drop across the load.

9. The device according to claim 8, wherein the first current balancing circuit determines the actual current based on a second difference between a first load input current and a second load input current.

* * * * *